US006448883B1

(12) United States Patent
Hofsäss

(10) Patent No.: US 6,448,883 B1
(45) Date of Patent: Sep. 10, 2002

(54) SWITCH HAVING AN END OF SERVICE POSITION IN ITS OPEN STATE

(76) Inventor: Marcel Hofsäss, Höfener Strasse 29, 75305 Neuenbürg (DE)

( * ) Notice: Subject to any disclaimer, the term of this patent is extended or adjusted under 35 U.S.C. 154(b) by 0 days.

(21) Appl. No.: 09/516,392

(22) Filed: Mar. 1, 2000

(30) Foreign Application Priority Data

Mar. 2, 1999 (DE) ..... 199 09 059

(51) Int. Cl.[7] ..... H01H 37/64; H01H 37/52

(52) U.S. Cl. ..... 337/373; 337/372; 337/375; 337/342

(58) Field of Search ..... 337/362, 388, 337/389, 397, 333, 342, 343, 365, 373, 375, 377, 380, 390, 391, 36, 52, 53, 85, 89, 372, 100–102, 131, 135, 141

(56) References Cited

U.S. PATENT DOCUMENTS

| | | | | | |
|---|---|---|---|---|---|
| 2,139,921 | A | * | 12/1938 | Weinhardt | 200/138 |
| 3,443,259 | A | * | 5/1967 | Wehl et al. | 337/89 |
| 3,959,762 | A | * | 5/1976 | Senor | 337/102 |
| 4,224,488 | A | * | 9/1980 | Rossi | 200/67 A |
| 4,259,557 | A | * | 3/1981 | Takano | 200/275 |
| 4,363,016 | A | * | 12/1982 | Unger | 337/56 |
| 4,389,630 | A | * | 6/1983 | Ubukata et al. | 337/363 |
| 4,399,423 | A | | 8/1983 | Nield | |
| 4,620,175 | A | * | 10/1986 | Karr et al. | 337/343 |
| 4,636,766 | A | * | 1/1987 | Carbone et al. | 337/368 |
| 5,367,279 | A | * | 11/1994 | Sakai | 337/104 |
| 5,781,097 | A | | 7/1998 | Givler | |
| 6,097,274 | A | * | 8/2000 | Hofsass | 337/362 |
| 6,133,817 | A | * | 10/2000 | Hofsass et al. | 337/377 |
| 6,181,233 | B1 | * | 1/2001 | Hofsass et al. | 337/377 |
| 6,191,680 | B1 | * | 2/2001 | Hofsass | 337/362 |
| 6,249,210 | B1 | * | 6/2001 | Hofsass | 337/324 |

FOREIGN PATENT DOCUMENTS

| | | | | |
|---|---|---|---|---|
| DE | 19636640 A1 | | 3/1998 | |
| JP | 1120719 A | * | 5/1989 | 200/182 |

* cited by examiner

*Primary Examiner*—Anatoly Vortman
(74) *Attorney, Agent, or Firm*—Harness, Dickey & Pierce, P.L.C.

(57) ABSTRACT

A switch has a temperature-dependent switching mechanism with a stationary contact element; a movable contact element coacting with the stationary contact element; and a bimetallic element, having a predetermined functional service life, that as a function of its temperature lifts the movable contact element away from the stationary contact element, the two contact elements being, in one switch position, in contact with one another in order to carry a current that is to be guided through the switch, and in a second switch position, lifted away from one another so that the switch is open. The two contact elements are arranged and coordinated with one another in such a way that when the functional service life of the bimetallic element is reached, the switching mechanism is welded in the second switch position.

10 Claims, 6 Drawing Sheets

SWITCH HAVING AN END OF SERVICE POSITION IN ITS OPEN STATE

BACKGROUND OF THE INVENTION

1. Field of the Invention

The present invention relates to a switch having a temperature-dependent switching mechanism that comprises a stationary contact element; a movable contact element coacting therewith; and a bimetallic element, having a predetermined functional service life, that as a function of its temperature lifts the movable contact element away from the stationary contact element, the two contact elements being, in one switch position, in contact with one another in order to carry or conduct a current that is to be guided through the switch, and in a second switch position, lifted away from one another so that the switch is open.

2. Related Prior Art

Switches of this kind, which are also called temperature controllers or temperature limiters, are commonly known from the prior art.

The known switches are used to protect an electrical load from overtemperature and/or excessive operating current. For this purpose it is connected, in series with the electrical load, to a voltage source for powering the load, and is arranged mechanically so that it is in close thermal contact with the load.

There are several design variants of such switches, which differ firstly in terms of whether the bimetallic part itself carries the current flowing through the switch or whether a spring element, which carries the current when the switch is in the closed state and is moved by the bimetallic element, is connected in parallel with the bimetallic element. It is furthermore known to equip the switch with series resistors and/or parallel resistors, the series resistor serving to heat the switch in the event of excessive current and the parallel resistor ensuring that when the switch is open, a residual current flows which generates heat in the parallel resistor such that the switch remains open.

As a rule, the switch is closed below the response temperature of the bimetallic element, so that the load is supplied with current. There are also designs, however, in which the switch activates, for example, a fan which is intended to cool the electrical load being protected if its temperature is too high.

The active switching elements in temperature-dependent switching mechanisms and switches of this kind are bimetallic or trimetallic elements that comprise two or three layers of different metals which have differing coefficients of thermal expansion, as is commonly known. When a temperature change occurs above or below the response temperature, switching elements of this kind snap back and forth, for example, between a convex and concave shape. The response temperature and the extent of the deformation upon switching are determined on the one hand by the material selection and material thickness, but also by mechanical dimples, etc.

An important criterion for the switching behavior of such bimetallic switching mechanisms is the speed at which the movable contact element is lifted away from the stationary contact element. If the switching speed is too slow, there can form between the two contact elements an undesirable arc that, in the most unfavorable case, welds the two contact elements to one another so that the switch is permanently closed.

Such a situation is of course undesirable, since it means that the switch can no longer perform its monitoring function. What is disadvantageous in this context is in particular the fact that this defect of the switch is initially not noticed, since the operating current of the load being protected continues to be carried through the switch. If the load then heats up to an excessive temperature, the switch can no longer open, which results in serious safety risks. The malfunction of the switch is not recognized at all until excessive heating of the load occurs, with the damage resulting therefrom.

For these reasons, in the known switches the bimetallic elements are adjusted—in terms of material selection, geometrical dimensions, and dimpling—so that they have a specific functional service life. The switches would then need to be replaced before the functional service life is reached.

A further measure for preventing welding between the two contact elements consists in designing them with an identical geometry that is matched to one another in such a way as to prevent the creation of arcs.

Since replacement of a switch upon reaching its functional service life cannot always be guaranteed, cut-out fuses that are connected in series between the switch and the load being protected are often additionally used in safety-relevant switches. While the switches with a temperature-dependent switching mechanism switch back on when the load cools off, the blow-out fuses irretrievably open the circuit. The cut-out fuses are designed so that they respond well above the response temperature of the temperature-dependent switch, so that they irretrievably open the circuit only if the bimetallic switch is no longer operating properly.

Such additional features are of course cost-intensive, so that they are disadvantageous for that reason alone. A further disadvantage is the fact that an additional component is necessary in order to monitor the load being protected; this requires physical space that often can be made available only with difficulty or not at all.

The functional service life of a bimetallic or trimetallic element is determined by fatigue phenomena resulting from frequent switching. Once a temperature-dependent switching mechanism of this kind has switched, for example, ten thousand times, the bimetallic element no longer snaps over abruptly when the response temperature is reached; instead the movable contact element at first moves only slightly away from the stationary contact element, and only when a greater temperature rise occurs the open position is reached, which might occur in the course of a creeping movement. When the switching capability of the bimetallic element has weakened in this fashion, there can form between the contact elements an arc which, while at first it is extinguished again, ultimately results—as the switching capability further weakens—in the aforementioned welding of the contact elements.

SUMMARY OF THE INVENTION

In view of the above, it is an object of the present invention to improve the switch mentioned at the outset such, that with a simple design, it reliably ends its service life in the open state.

With the switch mentioned at the outset, this object is achieved according to the present invention in that the two contact elements are arranged and coordinated with one another in such a way that when the functional service life of the bimetallic element is reached, the switching mechanism is welded in the second switch position; preferably the bimetallic element is welded in the second switch position, by an arc which forms when the functional service life of the bimetallic element is reached, to a preferably current-carrying part of the switch.

The object underlying the invention is completely achieved in this fashion.

Specifically, the inventor of the present application has recognized that by selecting the arrangement and the geometry of the two contact elements, it is possible to ensure that an arc which occurs welds the switch not—as in the prior art—in the closed state, but rather in the open state. This is therefore an departure from measures known from the prior art for preventing an arc; instead, according to the present invention, provision is made for a deliberately directed arc to weld the switch in the open position.

This exploits the fact that when the functional service life is reached—i.e. as the switching capability and spring force of the bimetallic element weaken because the speed with which the two contact elements move apart is now decreasing—an arc is formed between them; in the prior art, however, it is extinguished again by the geometry of the contact elements. According to the present invention, however, provision is made for this arc not to be extinguished, but rather to weld the switch in the open state.

It is particularly preferred in this context if, in the case of a switch having a first connection electrode joined to the stationary contact element and a second connection electrode joined to the movable contact element, the bimetallic element is joined to the second connection electrode and, in the second switch position, rests against the second connection electrode and is welded to the latter when an arc forms as the functional service life of the bimetallic element is reached as a result of fatigue thereof.

The advantage of this feature is that the current-carrying bimetallic element furthermore ensures that welding is accomplished in the open state in the transition region between still-sufficient opening force and extreme creep. The bimetallic element does not need to work against the force of a closing spring, so that the opening force is still sufficient actually to lift off the movable contact element, even if the bimetallic element has already arrived at the end of its functional service life.

It is further preferred if the switch is equipped with a first connection electrode joined to the stationary contact element and a second connection electrode joined to the movable contact element, the switching mechanism having a spring element that is joined at its first end to the second connection electrode and at its second end to the bimetallic element that carries the movable contact element at its free end.

The advantage here is that current flows through a series circuit made up of a temperature-neutral spring element and temperature-dependent bimetallic element; the spring element ensures reliable closing pressure for the closed switch, while the bimetallic element can deform in temperature-dependent fashion without greater mechanical stresses. Furthermore, during switching a transverse movement occurs between the two contact elements, ensuring that the arc which forms initially between the two contact elements is deflected onto the bimetallic element, and then welds the latter to a current-carrying part of the switch.

It is preferred in this context if the spring element and bimetallic element are arranged mechanically parallel to one another in such a way that they extend to the same side from their join with one another; also preferably, in the second switch position the bimetallic element rests against the spring element and is welded to the latter when the functional service life of the bimetallic element has been reached, so that an arc forms upon opening of the switch.

The inventor of the present Application has recognized that, in particular with this V-shaped arrangement of spring element and bimetallic element, an arc which forms as the switching force of the bimetallic element weakens is reliably deflected from the movable contact element onto the current-carrying bimetallic part and welds the latter to the (also current-carrying) spring element.

It is particularly preferred in this context if the stationary and the moving contact elements have different geometries in cross section.

The advantage here is that the different geometries of the contact elements also deflect the arc from the movable contact element onto the bimetallic element when the opening speed of the switching mechanism weakens as the functional service life is reached. This feature stands in contrast to the features previously believed in the prior art to be indispensable, according to which the contact elements must have a similar and mutually coordinated geometry in order to prevent arcs.

It is particularly preferred in this context if one of the two contact elements is approximately circular in cross section and the other is approximately rectangular; particularly preferably, the stationary contact element is circular in cross section and the movable contact element is square in cross section.

These features once again enhance the reliable formation of an arc which results in welding of the bimetallic element in its second switch position.

In summary, it may be stated that an arc which occurs as the switching capability weakens is deflected from the movable contact element onto the bimetallic element by the differences in geometry between the two contact elements. This effect is further reinforced by a bimetallic element, clamped at one end, that carries the current flowing through the switch, since the contact elements now do not encounter one another centeredly, but rather shift transversely with respect to one another, which enhances deflection of the arc.

Because the geometry of the stationary contact is angular in cross section, the arc is deflected in particularly reliable fashion from the movable, round contact element onto the current-carrying bimetallic element, so that it can strike through it to the current-carrying connection electrode or to the current-carrying spring element, and weld it thereto.

Further advantages are evident from the description and the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

Two embodiments of the invention are shown in the drawings and will be explained in more detail in the description below. In the drawings.

DESCRIPTION OF PREFERRED EMBODIMENTS

Figure 1:
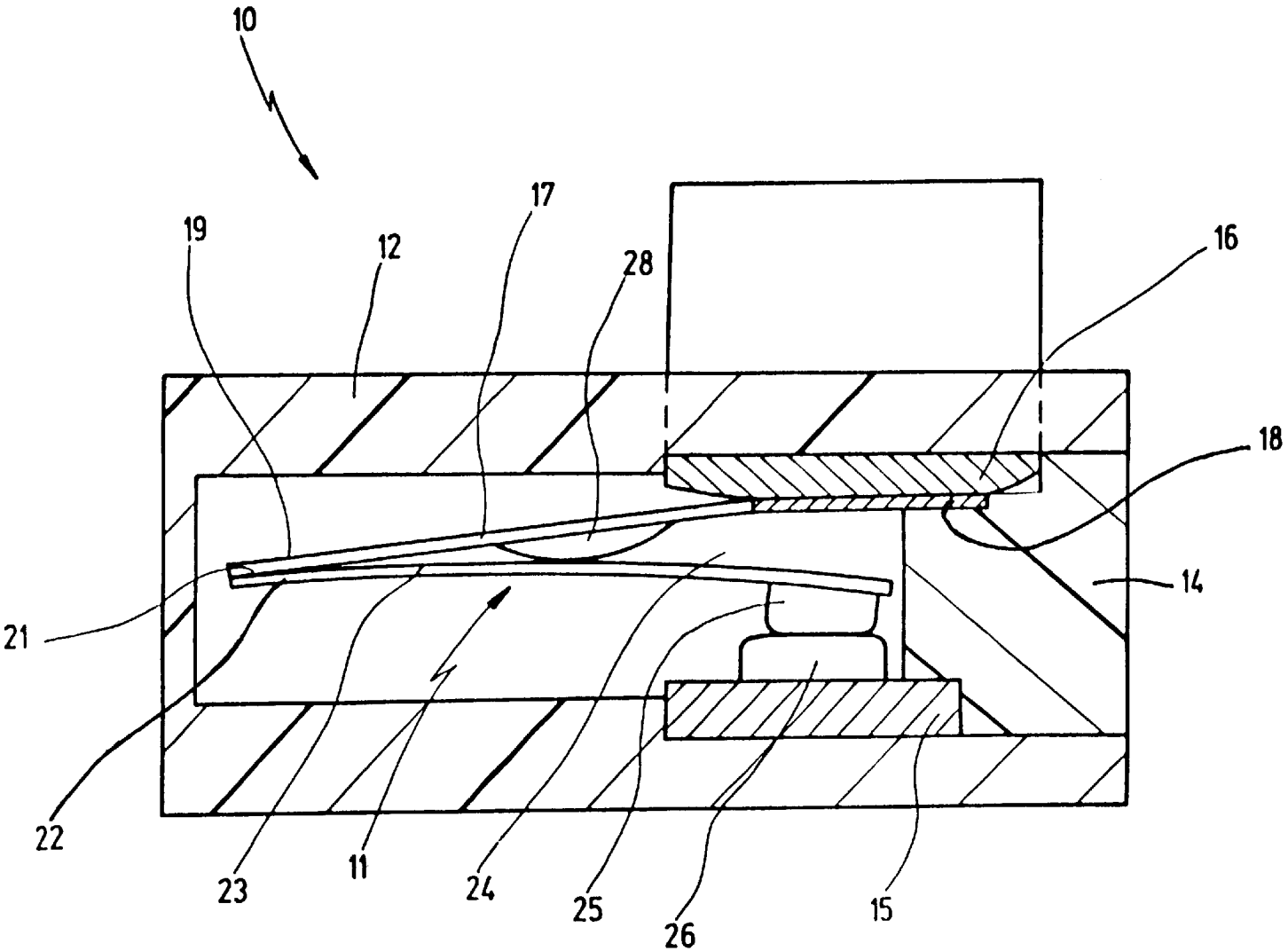
FIG. 1 shows a first embodiment of the new switch in a longitudinally sectioned side view, in the closed state.

In FIG. 1, 10 designates a switch in a longitudinally sectioned side view. Switch 10 comprises a temperature-dependent switching mechanism 11 that is housed in a plastic housing 12 and is held by a plastic support 14.

Arranged in plastic housing 12 are a first, lower connection electrode 15 and a second, upper connection electrode 16, between which switching mechanism 11 is electrically and mechanically provided.

Switching mechanism 11 comprises a T-shaped spring element 17 that is clamped with its first end 18, which is configured in the manner of a crossbeam, between plastic support 14 and second connection electrode 16. At its second end 19, spring element 17 has a connection 21 to a first end 22 of a bimetallic element 23 that carries at its free end 24 a movable contact element 25. This movable contact element 25 is associated with a stationary contact element 26 that is mounted on first connection electrode 15.

Spring element 17 and bimetallic element 23 extend, mechanically parallel to one another, on the same side of their join 21, a bulge 28 facing toward bimetallic element 23 being additionally provided on spring element 17.

When switch 10 is in the closed position shown in FIG. 1, an electrical current flows from first connection electrode 15 via the two contact elements 26, 25 and bimetallic element 23 into spring element 17, and from the latter into second connection electrode 16.

When bimetallic element 23 then heats up above its response temperature, either as a result of current flow or because of an excessively high ambient temperature, it snaps over from the concave position shown in FIG. 1 into a convex position in which it has lifted movable contact element 25 away from stationary contact element 26. This snapover at first occurs very quickly, so that an arc cannot form between the two contact elements 25, 26.

When bimetallic element 23 approaches the end of its functional service life, however, the opening of contact elements 25, 26 occurs no longer abruptly, but rather gradually in a creeping movement. This then results in intermediate states such as those shown in FIG. 2, in which movable contact element 25 is still at a short distance from stationary contact element 26, so that an arc indicated at 31, which continues to maintain the current flow, can form. As movable contact element 25 opens further, this arc 31 usually detaches.

Figure 3:
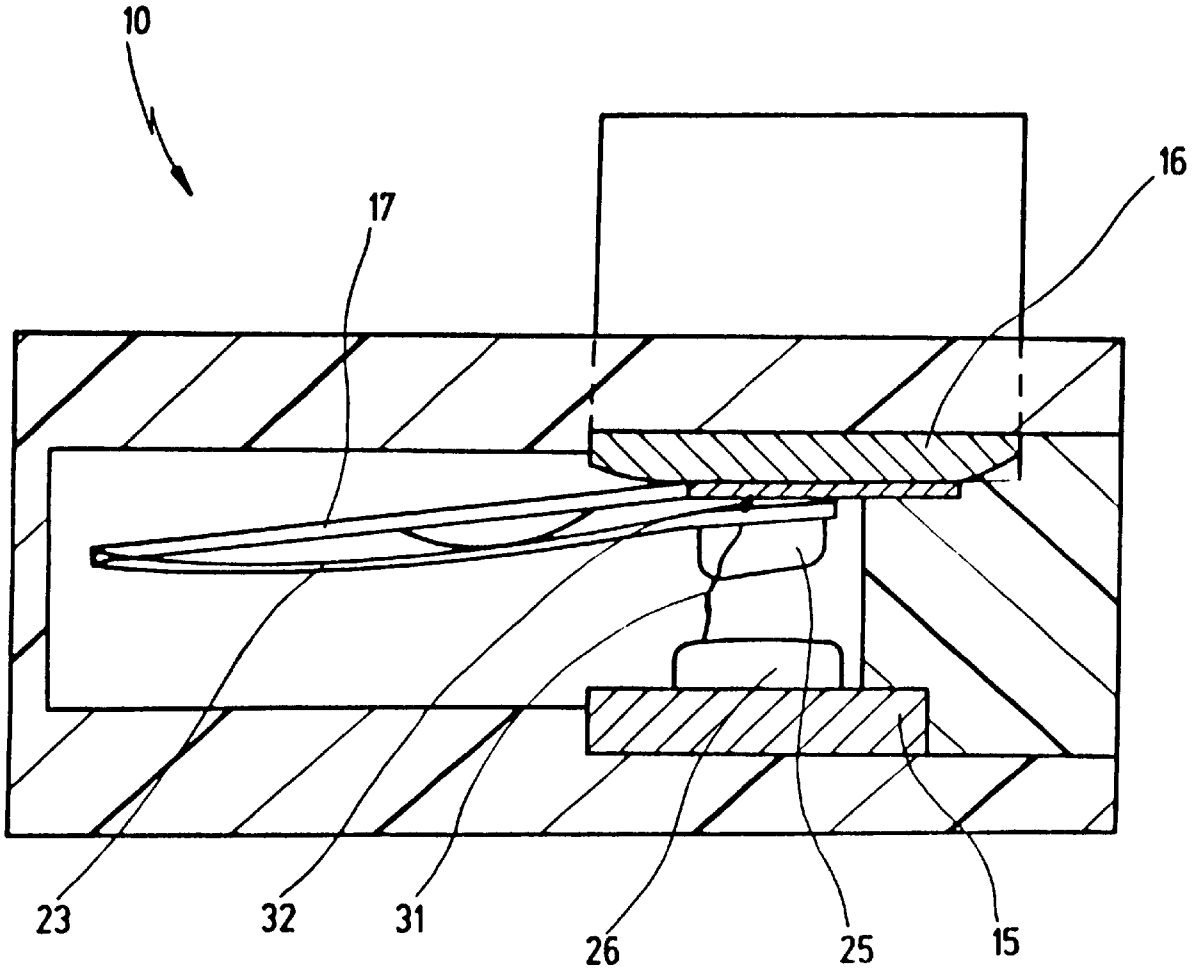
FIG. 3 shows a view like FIG. 2 but with the switch completely open.

When bimetallic element 23 reaches the end of its functional service life, however, arc 31 is deflected, in the second switch position of switching mechanism 11 shown in FIG. 3, onto bimetallic element 23, strikes through it, and welds it to first end 18 of current-carrying spring element 17 at a weld point indicated at 32. Switching mechanism 11 is thus held permanently open when the functional service life of bimetallic element 23 has been reached.

Figure 2:
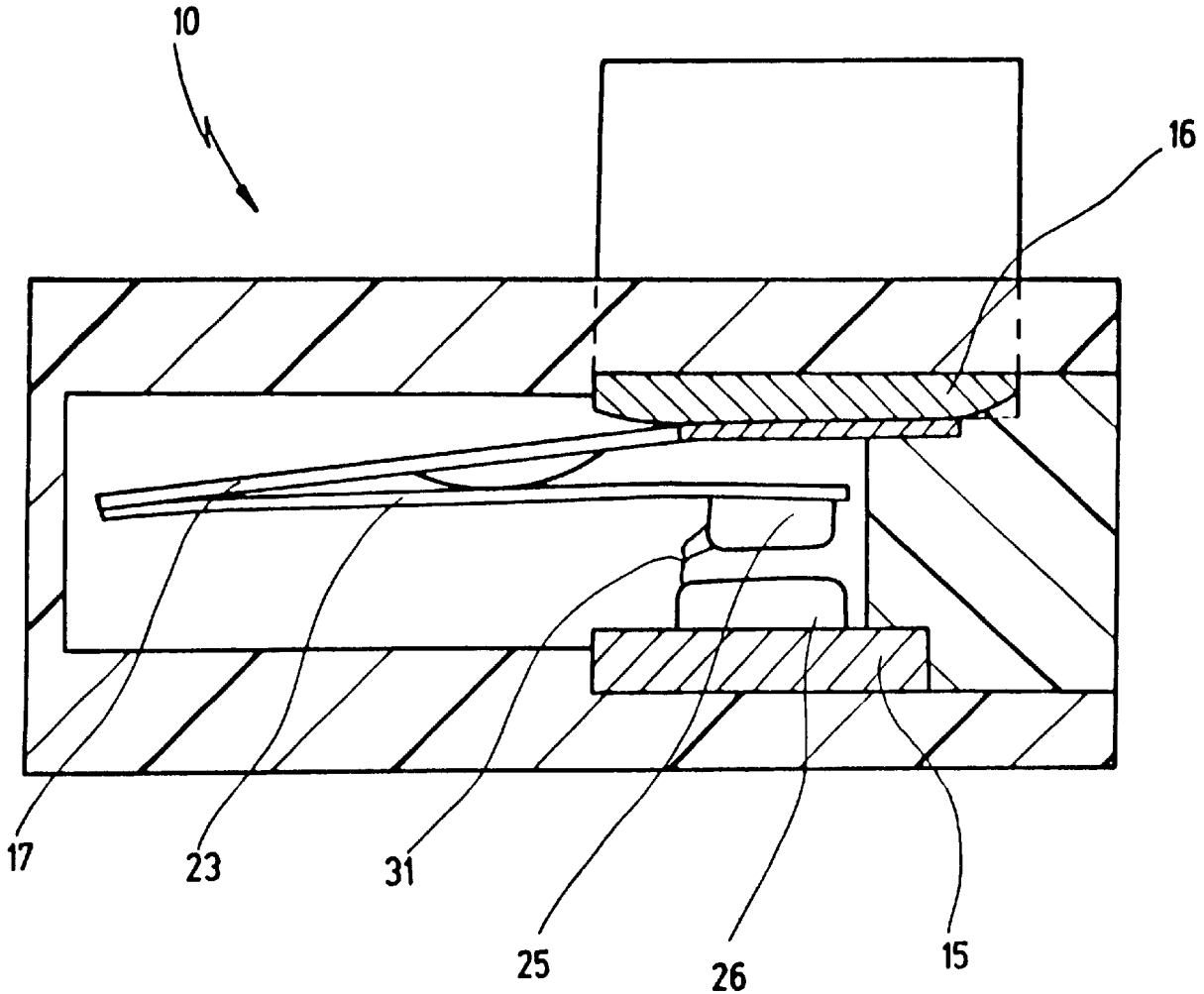
FIG. 2 shows a view like FIG. 1 but with the arc forming.
Figure 4:
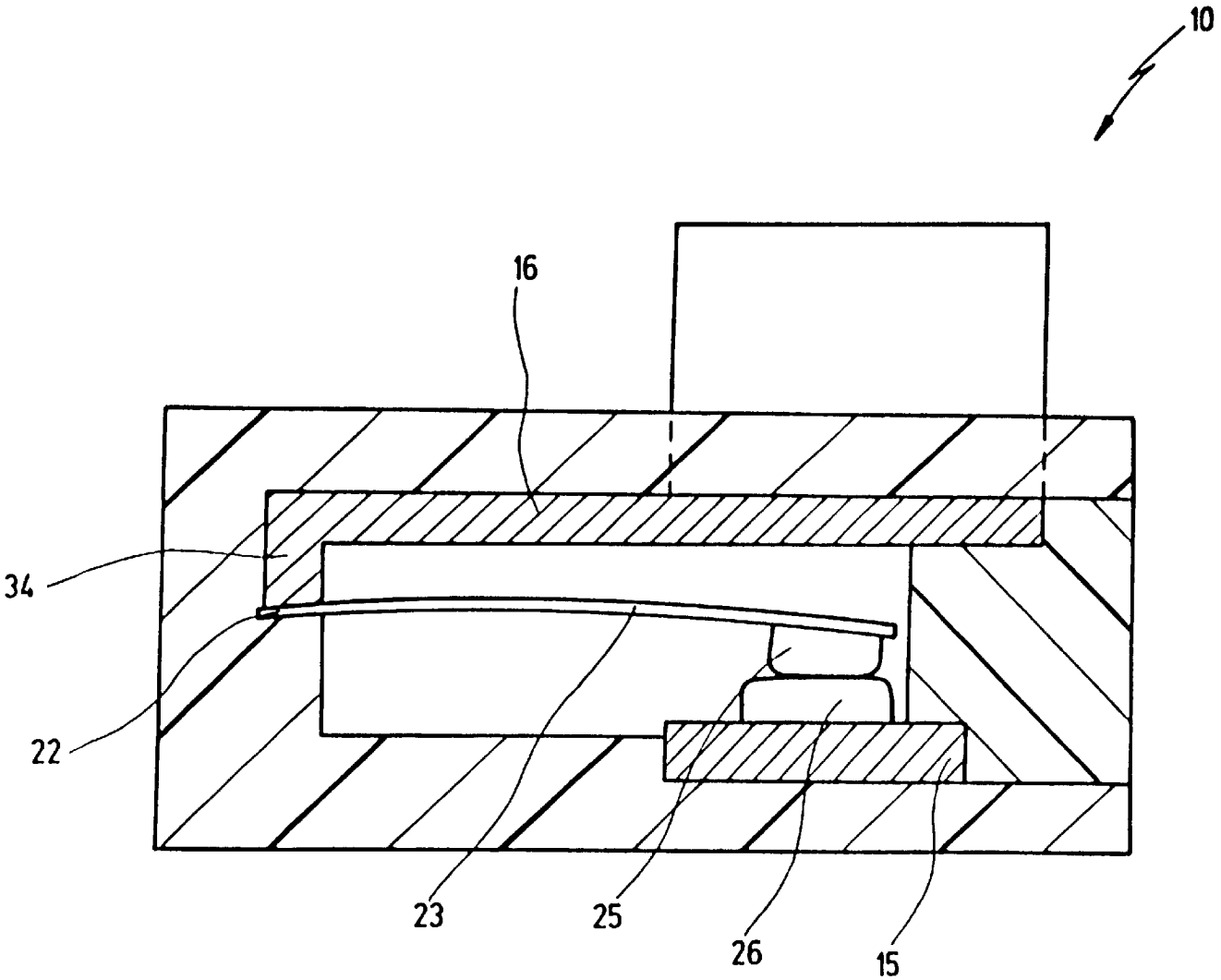
FIG. 4 shows, in a view like FIG. 1, a second embodiment of the new switch.

FIG. 4 shows, in a representation like FIG. 1, a second embodiment of the new switch 10 in which bimetallic element 23 is in direct contact at its first end 22 with second connection electrode 16, which for that purpose has a projection 34. The only difference as compared to the switching mechanism of FIGS. 1 through 3 is therefore that no spring element 17 is provided in the switch according to FIG. 4.

Figure 5:
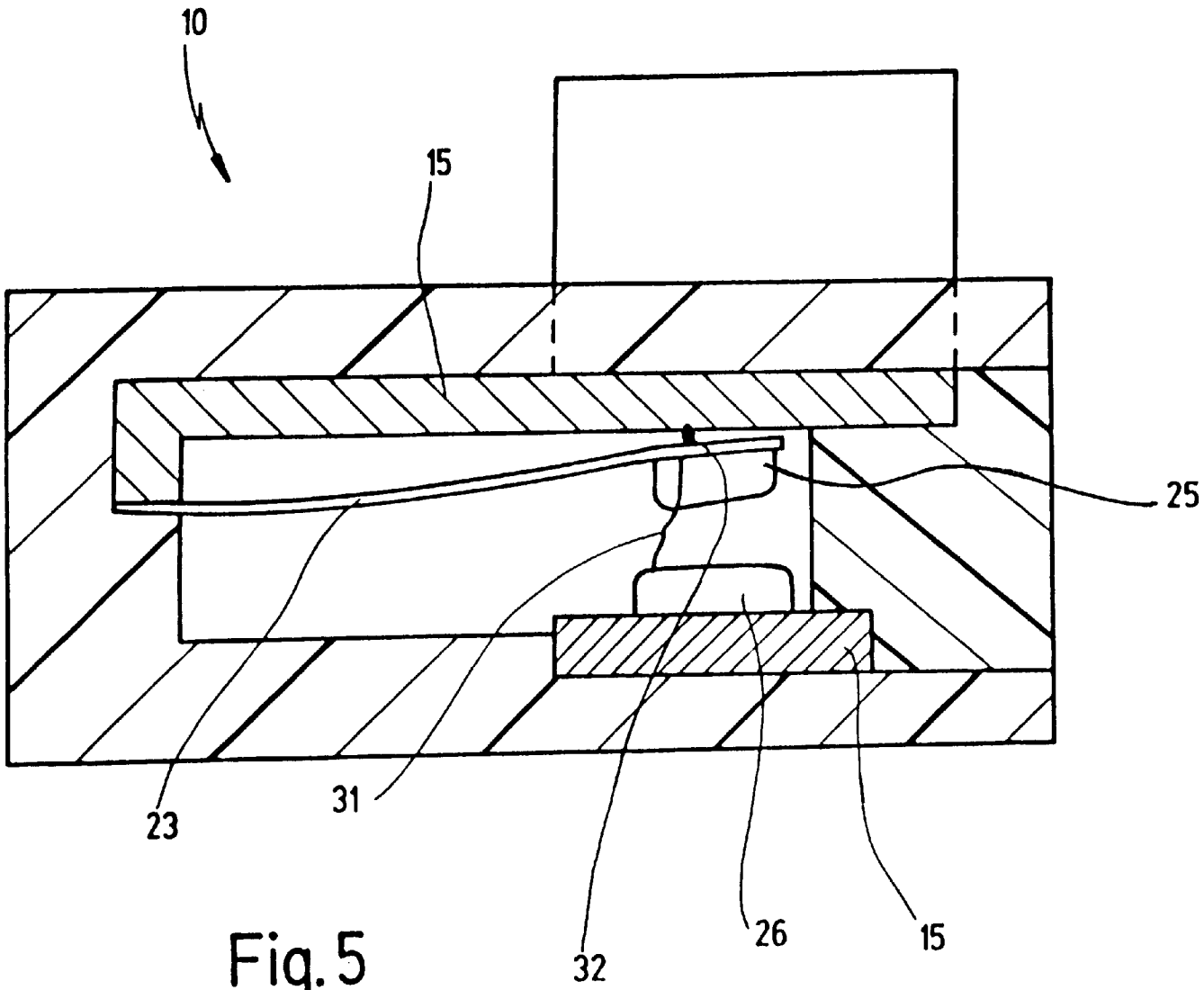
FIG. 5 shows the switch of FIG. 4 in the open state.

FIG. 5 shows the switch of FIG. 4 in the open state. It is evident that arc 31 which forms when bimetallic element 23 has reached its functional service life now welds bimetallic element 23 directly to the current-carrying second connection electrode 16.

Figure 6:
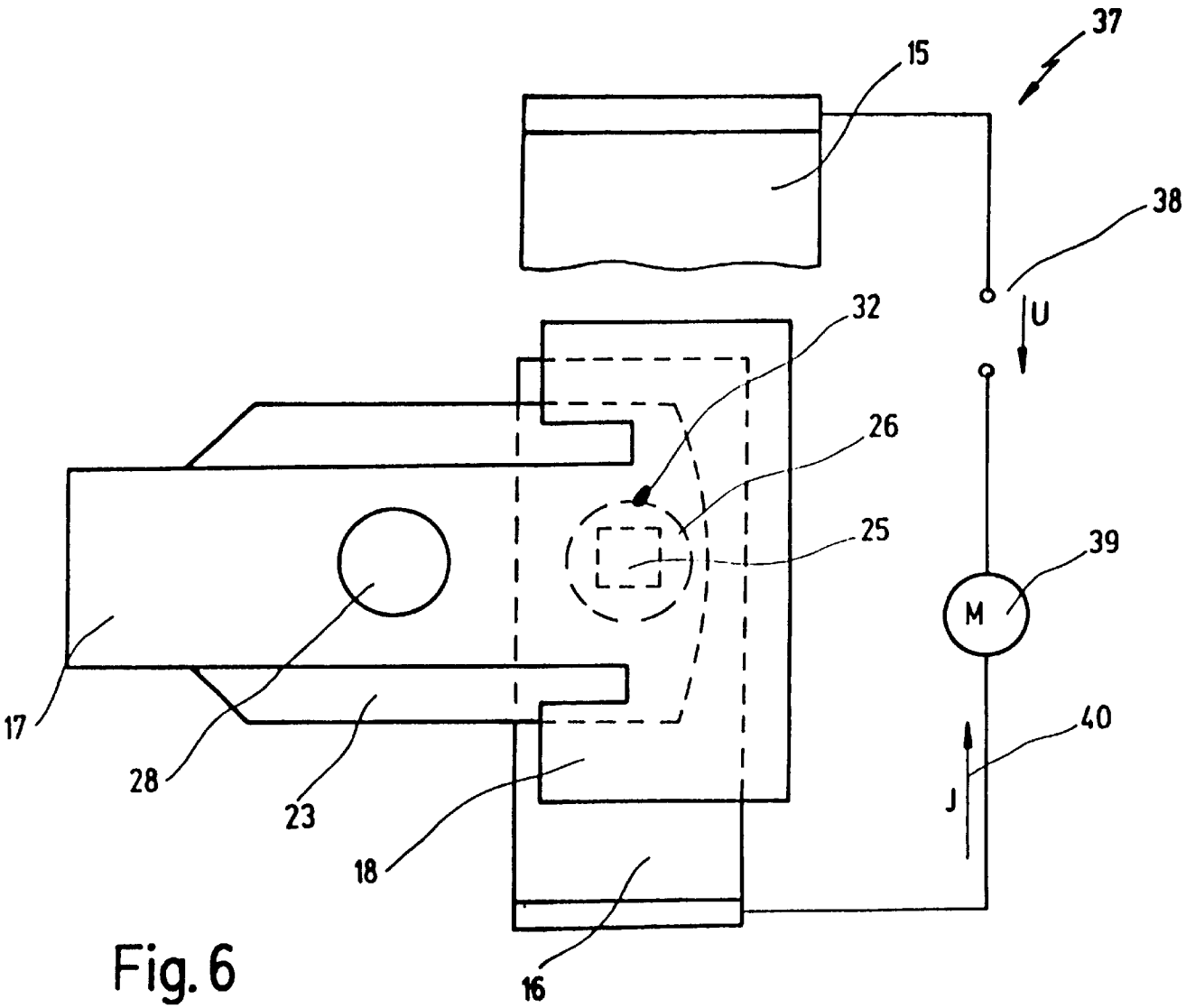
FIG. 6 shows a plan view of the switching mechanism of the switch of FIG. 1 without housing parts.

FIG. 6 shows switching mechanism 11 of FIG. 1 in a plan view, representation of the housing parts having been dispensed with for reasons of clarity.

It is evident from FIG. 6 that bimetallic element 23, which has the form of a bimetallic snap disk, is arranged beneath the T-shaped spring element 17. Also evident is bulge 28 of spring element 17 which promotes the snapover of the bimetallic snap disk.

Located beneath switching mechanism 11 is the first connection electrode 15, shown in section in FIGS. 1 through 5, which carries stationary contact element 26 that is of circular configuration in cross section. Associated with this stationary contact element 26, bimetallic element 23 carries the movable contact element 25, which is of square configuration in cross section and has a smaller surface area than round contact element 26.

This difference in cross section between the two contact elements 25, 26 ensures that an arc 31 which forms as switching mechanism 11 opens is deflected from movable contact element 25 onto bimetallic element 23, and results in weld point 32 which is indicated once again in FIG. 6.

The upper part of FIG. 6 shows, only for the sake of completeness and in broken-off fashion, second connection electrode 16, which extends above T-shaped spring element 17 and is in physical and therefore electrical contact with it.

FIG. 6 further shows an electrical circuit 37 made up of switching mechanism 11, voltage source 38, the electrical load being protected in the form of a motor 39, and a current 40 flowing through motor 39. Circuit 37 is connected to the two connection electrodes 15, 16 so that when switching mechanism 11 is in the closed state, current 40 is conveyed via the two contact elements 25, 26.

What is claimed is:

1. A switch having a temperature-dependent switching mechanism that comprises a stationary contact element; a movable contact element coacting with the stationary contact element; and a bimetallic element, having a predetermined functional service life, that as a function of its temperature lifts the movable contact element away from the stationary contact element, the two contact elements being, in one switch position, in contact with one another in order to carry a current that is to be guided through the switch, and in a second switch position, lifted away from one another so that the switch is open, which switch is equipped with a first connection electrode joined to the stationary contact element and with a second connection electrode joined to the movable contact element, wherein the switching mechanism has a spring element that is joined at its first end to the second connection electrode and at its second end to the bimetallic element that carries the movable contact element at its free end, wherein the two contact elements are having different geometries in a horizontal cross section and are arranged and coordinated with one another in such a way that when the functional service life of the bimetallic element is reached, the switching mechanism is welded in the second switch position.

2. The switch as in claim 1, wherein the spring element and bimetallic element are arranged mechanically parallel to one another in such a way that they extend to a same side from their join with one another.

3. The switch as in claim 2, wherein in the second switch position the bimetallic element rests against the spring element and is welded to the latter when the functional service life of the bimetallic element has been reached, so that an arc forms upon opening of the switch.

4. The switch as in claim 3, wherein one of the two contact elements is approximately circular in cross section and the other is approximately rectangular.

5. The switch as in claim 4, wherein the stationary contact element is circular in cross section and the movable contact element is square in cross section.

6. The switch as in claim 4, wherein one of the two contact elements is approximately circular in cross section and the other is approximately rectangular.

7. The switch as in claim 6, wherein the stationary contact element is circular in cross section and the movable contact element is square in cross section.

8. A switch having a temperature-dependent switching mechanism that comprises a stationary contact element; a movable contact element coacting with the stationary contact element, and movable relative thereto, generally along a first axis toward and away said stationary contact and a bimetallic element, having a predetermined functional service life, that as a function of its temperature lifts the movable contact element away from the stationary contact element, the two contact elements being, in one switch position, in contact with one another in order to carry a current that is to be guided through the switch, and in a second switch position, lifted away from one another so that the switch is open, said switch further having a first connection electrode joined to the stationary contact element, a second connection electrode joined to the movable contact element, and the bimetallic element joined to the second connection electrode and arranged so that in the second switch position, the bimetallic element rests against the second connection electrode, wherein the stationary and the moving contact elements are raised elements having different geometries in cross section, in a plane generally normal to the first axis and are arranged and coordinated with one another in such a way that when the functional service life of the bimetallic element is reached, the bimetallic element is welded to the second connection electrode when an arc forms as a result of fatigue thereof, the switching mechanism being welded in the second switch position.

9. The switch as in claim 8, wherein one of the two contact elements is approximately circular in cross section and the other is approximately rectangular.

10. The switch as in claim 9, wherein the stationary contact element is circular in cross section and the movable contact element is square in cross section.

* * * * *